US005431373A

United States Patent [19]

Lilja et al.

[11] Patent Number: 5,431,373

[45] Date of Patent: Jul. 11, 1995

[54] METHOD AND APPARATUS FOR INCREASING THE EFFICIENCY OF A WASTE HEAT BOILER

[75] Inventors: Launo Lilja; Kari Rajainmäki, both of Pori; Veli Salmi, Harjavalta; Heikki Teperi, Harjavalta; Pekka Tuokkola, Harjavalta, all of Finland

[73] Assignee: Outokumpu Harjavelta Metals Oy, Harjavalta, Finland

[21] Appl. No.: 218,725

[22] Filed: Mar. 28, 1994

[30] Foreign Application Priority Data

Apr. 2, 1993 [FI] Finland ..... 931500

[51] Int. Cl.[6] ..... C22B 1/00

[52] U.S. Cl. ..... 266/44; 266/148; 266/155

[58] Field of Search ..... 266/44, 155, 148

[56] References Cited

U.S. PATENT DOCUMENTS 3,815,882 6/1974 Regan ..... 266/155

4,475,947 10/1984 Andersson ..... 266/155

4,908,058 3/1990 Saarinen ..... 266/155

*Primary Examiner*—Scott Kastler

*Attorney, Agent, or Firm*—Brooks Haidt Haffner & Delahunty

[57] ABSTRACT

The invention relates to a waste heat boiler construction provided in succession to a suspension smelting furnace, particularly a flash smelting furnace, in which construction the dust-bearing gases created in the suspension smelting furnace are prevented from directly flowing from the radiation section of the waste heat boiler into the convection section thereof, in order to reduce the tendency to dust build-ups caused by these gases, and in order to advantageously utilize the total volume of the waste heat boiler and to extend the residence time simultaneously. The invention also relates to a method for intensifying the mixing of gases and for extending the total residence time in the radiation section of the waste heat boiler.

9 Claims, 1 Drawing Sheet

METHOD AND APPARATUS FOR INCREASING THE EFFICIENCY OF A WASTE HEAT BOILER

BACKGROUND OF THE INVENTION

1. Field of the Invention

The present invention relates to a waste heat boiler construction successive to a suspension smelting furnace, particularly a flash smelting furnace, in which construction the dust-bearing gases created in the suspension smelting furnace are prevented from directly flowing from the radiation section of the waste heat boiler to the convection section, in order to reduce the tendency to dust build-ups caused by the gases, and in order to advantageously utilize the total volume of the waste heat boiler as well as to extend the residence time. The invention also relates to a method for intensifying gas mixing and for extending the total residence time in the radiation section of the waste heat boiler.

2. Description of the Prior Art

Generally the waste heat boiler used after a suspension smelting furnace is a tunnel-type boiler operated with direct gas flow, which boiler is divided into two sections, the radiation section and the convection section. The purpose of the radiation section is to cool the gases so that the molten particles contained in the gas are solidified and their temperature decreases to below the particle sintering temperature before the gases are conducted to the convection section of the waste heat boiler. In the convection section, the end heat contained by the dust-bearing gases is recovered by means of a cooling tube bank.

However, in tunnel-type waste heat boiler constructions the high dust content of the gases created in suspension smelting often results in dust build-ups which hamper the operation of both the waste heat boiler and the whole suspension smelting process. The losses caused for the producers by possible interruptions in the suspension smelting process due to these difficulties are remarkable. The tendency to dust build-ups is favoured for instance by the following factors:

In the radiation section of the waste heat boiler, only the ceiling and the upper parts of the walls are in efficient use, and only when they are clean. Because a large share of the heat load is directed onto a small proportion of the boiler, it is difficult to keep the waste heat boiler clean. Further, the hot dust-bearing gases flow, partly uncooled, directly to the convection section of the boiler, in which case molten dust particles stick to the cooling tube bank, and the cooled particles are sintered. Moreover, the bottom part of the waste heat boiler works poorly as a radiation receiver, but allows a long residence time for part of the dust-bearing gases, thus creating conditions for a disadvantageous reaction where sulfur dioxide is oxidized into sulfur trioxide. At the gas scrubbing stage of a sulfuric acid plant, sulfur trioxide forms sulfuric acid, so-called scrubbing acid, which often is not far from hazardous waste.

The removal of dust build-ups from a waste heat boiler has been attempted in many different fashions; the cleaning of the boiler has been intensified by means of hammering devices—with positive results, but only in removing dust, not eliminating the cause of the problem. The disadvantages of too intensive hammering will soon be obvious: the working life of the waste heat boiler is shortened. In the radiation section of the waste heat boiler, there have also been constructed cooling panels parallel to the boiler, so that the gas can freely flow in between the said panels; these panels are known to work well, if they are correctly designed. Moreover, transversal cooling panels—i.e. transversal to the gas flowing direction—have been tested in the radiation section of the boiler. However, the experiences have been disappointing because of an active tendency to slag crust formation. Attempts have also been made to prevent the direct flowing of the gas along the ceiling of the radiation section of the waste heat boiler, by placing the convection section lower than the radiation section, so that the rear part of the ceiling of the radiation section is inclined downwards.

From the U.S. Pat. No. 4,530,311 there is known a waste heat boiler where the construction of the radiation section has been altered in order to eliminate the drawbacks of the above described constructions. In relation to the front end of the radiation section, the convection section of the waste heat boiler is located on an essentially lower level in order to prevent the dust-bearing gases from flowing directly along the ceiling of the radiation section. The ceiling of the radiation section is constructed so that the radiation section is stepwise lowered down to the level of the front end of the convection section, and state-of-the-art hammering devices are at the same time switched to the wall. Thus it is possible to make use of the bottom of the radiation section that in prior art embodiments remains inefficient. Morerover, in the ceiling of the radiation section, there are installed panels parallel to the gas flowing direction, so that in the compartments formed by the transversal walls of the radiation section, the panel of the successive compartment always divides the gas flows from the previous compartment more or less into two.

SUMMARY OF THE INVENTION

The object of the waste heat boiler construction of the present invention is to eliminate the drawbacks of the above described prior art constructions and to achieve an improved and operationally more secure waste heat boiler suited in the cooling of dust-bearing gases created in the suspension smelting process, as well as for collecting dust, which goal is advantageously suitable for improving the capacity of old boilers, too. The invention also relates to a corresponding method for an efficient mixing of gases and for extending the total residence time in the radiation section of the boiler.

According to the invention, the ceiling in the front end of the radiation section of a standard tunnel-type waste heat boiler is raised 5–20%, advantageously 15% higher, so that in the front end there is formed a cave-like space whereto the hot gas discharged from the smelting furnace rises in the form of a back-flow, without striking directly in a "sharp" and hot jet to the ceiling tube bank. The ceiling is raised at the front end of the radiation section only, i.e. halfway in the gas flowing direction, at the most.

Immediately after the rear wall of the elevated part, the invention comprises a ceiling drop transversal to the flow, which drop continues downwardly from the normal-height ceiling of the radiation section and forms a duct in the radiation section of the boiler, this duct in turn being restricted by two walls formed of tubular panels and a bottom. The said duct houses insulation and hammering devices and has enough room for carrying out the maintenance of the equipment. The transversal downwardly duct must be open at the sides and top of the radiation section. The purpose of the drop is to turn downwards the hot main gas flow discharged from the furnace and to make it thereafter curve upwards from under the duct and form an upwardly flowing current towards the convection section.

By means of the present invention, more cooling surface is obtained in the radiation section, both in the elevated part and in the transversal duct. The degree of filling in the radiation section is raised and consequently the residence time extended, both absolutely and relatively. According to the invention, the incoming hot gas flow is made to turn off from the ceiling of the radiation section and the dust is made to gather mainly at the front end of the radiation section.

When gas is discharged from a smelting furnace, its temperature is in the region 1,300° C. While the gas cools off down to 800°-600° C., the dusts are sulfatized, and the metal-bearing particles contained in the gas are oxidized for instance owing to the excess air discharged from the bottom end of the radiation section and are dropped to the funnel-like chutes onto the bottom of the radiation section. From the point of view of gas processing, the sulfatizing of the dusts is an advantageous phenomenon, but if the gas temperature is allowed to drop down to the region 600°-500° C., the ensuing gas reaction is the oxidizing of sulfur dioxide to sulfur trioxide, which is a harmful phenomenon as was noted above.

In a radiation section with a standard construction, underneath the main current striking the ceiling there is created in the gas flow a big ineffectual back-flow, where the gas remains in turbulence and cools down to undesirable temperatures. Owing to the structure of the invention, both the too fast main current and the big back-flow are divided into several small and efficiently gas-mixing turbulences, wherefrom the gas is, however, discharged further before its temperature decreases to the region where the undesirable reactions take place. Thus the total gas residence time increases, but there is not enough time for the temperature to drop down to the undesirable region.

A controlled upper eddy in the elevated part of the radiation section enables the optimization of the fairly popular circulation gas jets and their mixing to the incoming gas flow. The gases of the upper eddy are cooled more efficiently than the hot gas flame striking the ceiling of an ordinary boiler. Now we approach the optimum temperature of dust sufatizing, i.e. 700°±100° C., whereto the oxygen-bearing circulation gas is fed, and thus the proceeding of sulfidic dust into the convection section is prevented.

The present invention also advantageously uses elongate cooling pipe panels parallel to the current flow in order to increase the cooling surface. The panels may be located either in the elevation part and therebelow, or after the transversal drop. All this is made possible by the fact that the hammering can be carried out both from the ceiling or from inside the duct formed by the transversal drop.

BRIEF DESCRIPTION OF THE DRAWING

The invention is explained in more detail below, with reference to the appended drawings, where.

DESCRIPTION OF THE PREFERRED EMBODIMENT

Figure 1:
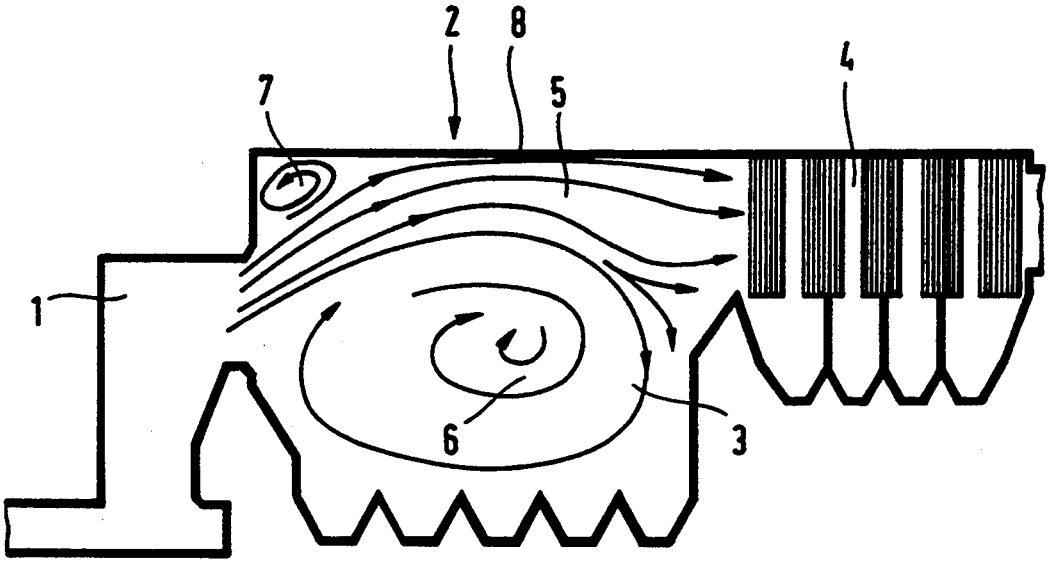
FIG. 1 is a schematical side-view illustration of a regular application of a state-of-the-art waste heat boiler construction with flow patterns in vertical cross-section.

FIG. 1 illustrates the main gas flow 5 and its back-flows 6 and 7 discharged from the smelting furnace 1 into the radiation section 3 and then into the convection section 4 of the waste heat boiler 2. The back-flow 6 is large and slow. Its exchange rate and consequently mixing efficiency is weak. The collision point of the hot gas flow to the ceiling 8 of the radiation section also is marked in the drawing.

Figure 2:
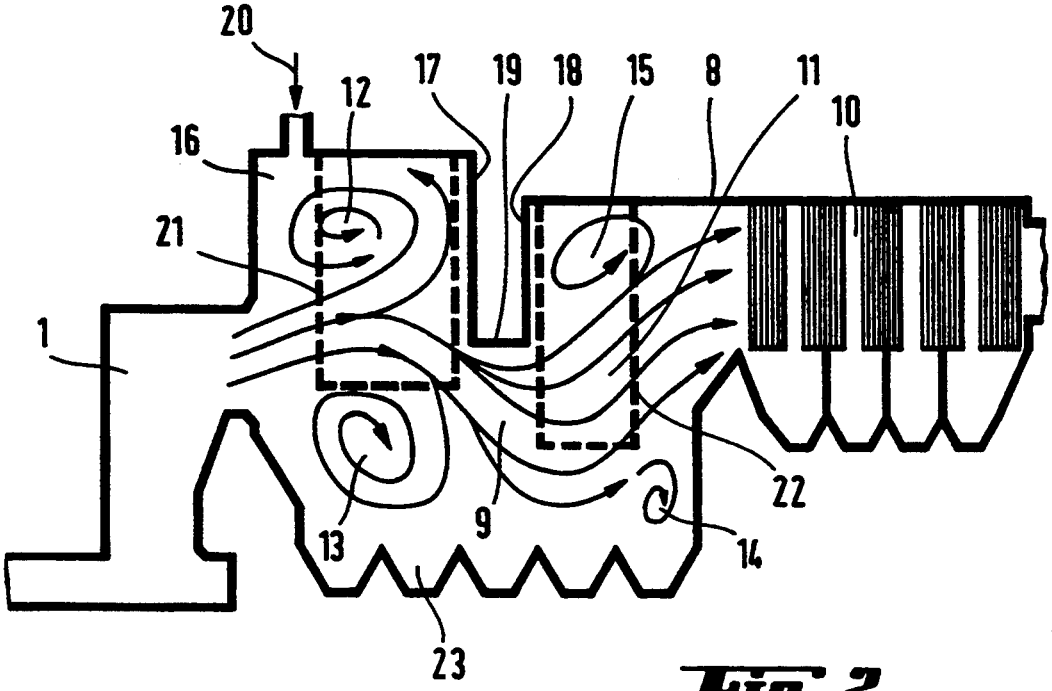
FIG. 2 is a schematical side-view illustration of a waste heat boiler construction of the present invention in vertical cross-section.

FIG. 2 illustrates the main gas flow 11 and its turbulences or back-flows 12, 13, 14 and 15 flowing from the smelting furnace 1 to the radiation section 9 and then continuing to the convection section 10. FIG. 2 also includes the elevation 16 of the front end of the radiation section according to the invention, and the transversal flow reversing duct structure formed of two, essentially vertical double panel walls 17 and 18 and of a bottom plate 19 therebetween, complete with the intermediate space with room for hammering devices, heat insulation and even the operations of maintenance personnel. The panel walls and the bottom therebetween extend transversally over the whole radiation section of the boiler. In the elevated part 16, there is also marked the widely used circulation gas nozzle 20. The longitudinal heat recovery walls made of three or more parallel heat pipe panels in the flowing direction are represented both in the front 21 and rear part 22.

The final recovery of heat takes place in the convection section of the waste heat boiler, whereto the gases enter after being cleaned of the major part of solid impurities. The majority of these impurities fall in the funnel-like chutes 23 on the bottom of the radiation section, and can be removed therefrom. The solid material stuck to the panels also ends up in the chutes, because the panels are provided with hammering devices widely used in the field of the invention, and these hammering devices drop the gathered solids down from time to time. The bottom of the convection section also is provided with funnel-like parts in order to recover and remove solids that are further separated from the gases. In the convection section, heat is recovered into the vapor/liquid circulating in the cooling tube bank.

The gases exhausted from the waste heat boiler are already fairly clean, and can thus be conducted for final scrubbing into an electrofilter prior to being transferred for instance to the next process step.

We claim:

1. In combination with a suspension smelting furnace, a horizontal waste heat boiler for receiving from the suspension smelting furnace hot dust-bearing gases created in the furnace, which gases contain molten particles that tend to adhere to and collect on boiler surfaces, said waste heat boiler comprising a radiation section for cooling the hot gases received from the furnace and thereby causing the molten particles contained in the gases to solidify and a convection section following the radiation section for receiving gases from the radiation section and further cooling the gases, wherein the radiation section has a front portion in the direction of gas flow with an elevated ceiling so that hot gases received from the furnace rise toward the elevated ceiling, the front end portion having a rear wall extending downward from said elevated ceiling, said rear wall being followed in the direction of gas flow by a transverse flow reversing duct defined beneath a transverse plate, the flow reversing duct having a ceiling drop for causing the gas flow to turn downwards before the gases enter a rear portion of the radiation section having a rear portion ceiling that is lower than the elevated ceiling of the front end portion and higher than the ceiling drop beneath the transverse plate, said radiation section rear portion being followed in the direction of gas flow by the convection section.

2. The combination of claim 1 wherein the ceiling drop is no greater than half the total height of the rear portion of the radiation section.

3. The combination of claim 1 wherein the elevated ceiling is 5–20% higher than the height of the ceiling of the rear portion of the radiation section.

4. The combination of claim 1 wherein the elevated ceiling is 15% higher than the height of the ceiling of the rear portion of the radiation section.

5. The combination of claim 1 wherein the transverse plate extends between the lower ends of two vertical double panel walls, and including hammering devices and heat insulation located at the flow reversing duct.

6. The combination of claim 1 and including cooling pipe panels in the radiation section, which panels are arranged parallel to the direction of gas flow.

7. A method for extending the residence time of dust-bearing hot gases flowing from a suspension smelting furnace into a radiation section of a waste heat boiler comprising interposing a transversal flow reversing duct in the radiation section to produce at least two separate, controlled turbulences at a front end portion of the radiation section upstream of the flow reversing duct and to produce in a rear end portion of the radiation section additional turbulences smaller than said two turbulences, which turbulences and additional turbulences increase the residence time of the gas in the radiation section and cause separation of dust from the gases to occur principally in the front end portion.

8. The method of claim 7 including reducing the transverse flow area of gases through the waste gas boiler by no more than half at the flow reversing duct.

9. The method of claim 7 including removing dust from the radiation section of the waste heat boiler by the use of hammering means.

* * * * *